US006217426B1

(12) United States Patent
Tolles et al.

(10) Patent No.: US 6,217,426 B1
(45) Date of Patent: Apr. 17, 2001

(54) CMP POLISHING PAD

(75) Inventors: Robert D. Tolles, Santa Clara; Steven T. Mear, Los Gatos; Gopalakrishna B. Prabhu, Sunnyvale; Steven Zuniga, Soquel; Hung Chen, San Jose, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/287,575

(22) Filed: Apr. 6, 1999

(51) Int. Cl.[7] ..... B24B 1/00

(52) U.S. Cl. ..... 451/285; 457/921; 457/526; 457/288

(58) Field of Search ..... 457/94, 285–289, 457/41, 526

(56) References Cited

U.S. PATENT DOCUMENTS

| | | | | |
|---|---|---|---|---|
| 5,212,910 | * | 5/1993 | Breivogel et al. | 451/530 |
| 5,257,478 | | 11/1993 | Hyde et al. . | |
| 5,486,129 | | 1/1996 | Sandhu et al. . | |
| 5,489,233 | | 2/1996 | Cook et al. . | |
| 5,578,362 | | 11/1996 | Reinhardt et al. . | |
| 5,605,760 | | 2/1997 | Roberts . | |
| 5,658,183 | | 8/1997 | Sandhu et al. . | |
| 5,664,989 | * | 9/1997 | Nakata et al. | 451/533 |
| 5,725,420 | * | 3/1998 | Torii | 451/287 |
| 5,730,642 | | 3/1998 | Sandhu et al. . | |
| 5,738,574 | | 4/1998 | Tolles et al. . | |
| 5,795,218 | * | 8/1998 | Doan et al. | 451/921 |
| 5,853,317 | * | 12/1998 | Yamamoto | 451/921 |
| 5,888,121 | | 3/1999 | Kirchner et al. . | |

* cited by examiner

*Primary Examiner*—David A. Scherbel
(74) *Attorney, Agent, or Firm*—Thomason, Moser & Patterson

(57) ABSTRACT

A polishing pad for use in a chemical mechanical polishing system is provided. The pad is mounted to a rotatable platen and comprises a polishing surface and a deflection surface which provides a desired degree of rigidity and compliance to the pad when brought into contact with a substrate. The deflection surface may comprise one or more passageways extending through the pad which vent to atmosphere. In one embodiment, the deflection area defines a raised area and a recessed area. The raised area provides a mounting surface for the platen while the recessed area allows for compliance of the pad. In another embodiment, the deflection area comprises a plurality of channels defining a plurality of slanted protrusions. The channels may be non-intersecting such that the slanted protrusions are elongated portions disposed on the pad. Alternatively, the channels may be intersecting such that the slanted protrusions are isolated from one another and are disposed on the pad in spaced relation.

44 Claims, 7 Drawing Sheets

CM P POLISHING PAD

BACKGROUND OF THE INVENTION

1. Field of the Invention

The present invention relates to an apparatus for polishing substrates. More particularly, the invention relates to a platen/polishing pad assembly having a compliant surface to improve polishing uniformity of substrates.

2. Background of the Related Art

In the fabrication of integrated circuits and other electronic devices, multiple layers of conducting, semiconducting and dielectric materials are deposited and removed from a substrate during the fabrication process. Often it is necessary to polish a surface of a substrate to remove high topography, surface defects, scratches or embedded particles. One common polishing process is known as chemical mechanical polishing (CMP) and is used to improve the quality and reliability of the electronic devices formed on the substrate.

Typically, the polishing process involves the introduction of a chemical slurry during the polishing process to facilitate higher removal rates and selectivity between films on the substrate surface. In general, the polishing process involves holding a substrate against a polishing pad under controlled pressure, temperature and rotational speed (velocity) of the pad in the presence of the slurry or other fluid medium. One polishing system that is used to perform CMP is the Mirra® CMP System available from Applied Materials, Inc., and shown and described in U.S. Pat. No. 5,738,574, entitled, "Continuous Processing System for Chemical Mechanical Polishing," the entirety of which is incorporated herein by reference.

An important goal of CMP is achieving uniform planarity of the substrate surface. Uniform planarity includes the uniform removal of material from the surface of substrates as well as removing non-uniform layers which have been deposited on the substrate. Successful CMP also requires process repeatability from one substrate to the next. Thus, uniformity must be achieved not only for a single substrate, but also for a series of substrates processed in a batch.

Substrate planarity is dictated, to a large extent, by the construction of the CMP apparatus and the composition of the consumables such as slurry and pads. In particular, a preferred construction allows for a proper balance between rigidity (or stiffness) and compliance (or flexibility) of the polishing device, and in particular to the stiffness and compliance of the polishing pad. In general, stiffness is needed to ensure within-die uniformity while sufficient compliance provides within-substrate uniformity. Within-substrate uniformity refers to the ability of the CMP apparatus to remove features across the diameter of the substrate regardless of substrate shape and/or topography across its surface. Within-die uniformity refers to the ability of the CMP apparatus to remove features within a die, regardless of size and feature density.

Conventional polishing systems typically include a platen having a polishing pad disposed thereon. Current state of the art strongly suggests the use of more than one polishing pad to provide compliance to the pad for improved results both within-substrate and within-die. For example, two pads are typically assembled together into a stack, which may be termed a "composite polishing pad." The composite pad usually includes combination of a rigid pad and a compliant pad. A typical polishing apparatus 10 comprising a metal platen 12 having a composite polishing pad 14 mounted thereto is shown in FIG. 1. Both the composite polishing pad 14 and the platen 12 are generally disc-shaped and of equal diameters. The top (upper) pad 16, is brought into contact with a substrate to perform the polishing process, while the bottom (lower) pad 18 is secured to a smooth upper mounting surface of the rotatable platen 12 to provide a seating surface for the top pad 16. An adhesive 20, such as a pressure sensitive adhesive (PSA) is provided on the back face of the pads 16, 18 to bond the pads to one another and to the platen 12. The top pad 16 is typically made of cast polyurethane while the bottom pad 18 is typically made of polyester felt stiffened with polyurethane resin. Other pads having different material composition are also available and known in the industry.

Generally, it is preferable that the top pad 16 be stiffer than the more compliant bottom pad 18 to provide a sufficiently rigid polishing surface. Typically, stiffness provides better within-die uniformity, while some compliance is needed to ensure within-substrate uniformity. The combination of pads having the proper proportions of stiffness and flexibility can achieve good planarity and uniformity over the surface of the substrate. In addition, the polishing profile on a substrate can be changed or modified by changing the thickness of either or both of the upper and lower pads. The change in thickness without a change in composition can change the properties of the composite pad in terms of stiffness and compliance.

However, a number of problems are associated with the conventional composite, or stacked, pad construction. One problem with composite pads is the interdependence of the individual pads upon one another. For example, a pressure exerted on the upper pad is transmitted to the lower pad. Because the upper pad is generally a rigid material having limited compressibility, the upper pad accommodates the pressure by translation, or displacement, of its position. Consequently, the lower pad experiences a pressure due to the deflection of the upper pad. The pressure on the lower pad is absorbed by compression of the lower pad. The total compressed volume of the lower pad depends at least partially on the compressibility of the material. However, because the compression cannot be completely localized to the origin of the pressure, the lower pad will experience deformation around the perimeter of the applied pressure. In the case of a shearing force, such deformation can result in ripples or waves on the lower pad due to the mass compression and redistribution of the lower pad, much like the effect of a shearing force applied to a carpet or rug. During operation, the waves exert a resultant force on the upper pad which can result in non-uniform polishing and undermines the goal of substrate planarization.

Another problem with composite pads is that each additional layer, e.g., pad and adhesive layer, in the stack acts as a source of variation affecting the overall stiffness, compression and/or compliance of the stack. The greater the number of layers or even variations in the thickness of pads, the greater the potential for variation. As a result, a polishing device utilizing a composite polishing pad is often unable to achieve desired polishing results over a number of substrates. Specifically, variation in compressibility, loss of within-substrate uniformity, uncontrolled wetting of the lower pad, and variation from pad to pad result due to multiple process variables. In addition, the planarity changes as the top pad is worn away by a process known as conditioning the pad. As the top pad is reduced in thickness, the planarity may decrease with increasing numbers of substrates polished on the pad.

One solution has been to minimize the number of layers in the composite polishing pad. Thus, the goal in CMP would be to remove the bottom pad and secure the top pad directly to the upper surface of the platen. Removal of the bottom pad also eliminates the need for one layer of the adhesive. However, it has been discovered that elimination of the bottom pad and mounting the polishing pad directly on the platen results in an overly rigid pad/platen assembly which compromises the compliance of the assembly. The rigidity is a consequence of directly interfacing the rigid top pad with the non-compliant platen surface, typically made of aluminum, ceramic, granite or other materials.

Therefore, there is a need for a platen/pad assembly which eliminates the problems of conventional bottom pads while providing sufficient compliance and rigidity during polishing.

SUMMARY

The present invention generally provides an apparatus for polishing a substrate which enhances polishing pad compliance and improves substrate and die uniformity. The apparatus is preferably adapted for incorporation into a chemical mechanical polishing system.

In one aspect of the invention, a pad assembly is provided having a patterned lower surface to define a raised area and a recessed area. The raised area provides a mounting surface to mount the pad assembly on a platen, while the recessed area provides a volume in which a desired degree of compliance of the pad assembly is accommodated.

In another aspect of the invention, a pad assembly is provided comprising a polishing pad and a plurality of protrusions disposed thereon. Preferably, the polishing pad has a first hydrostatic modulus greater than a second hydrostatic modulus of the protrusions. The polishing pad provides a desired degree of rigidity and the protrusions provide a desired degree of compressibility.

In another aspect of the invention, a pad assembly is provided comprising a polishing pad and a plurality of protrusions disposed thereon. The protrusions are preferably intermittently disposed on the pad in isolation from one another and define a platen mounting surface. The protrusions define a plurality of intersecting grooves preferably extending at each end to the perimeter of the polishing pad.

In another aspect of the invention, a pad having a polishing surface and a patterned surface is provided. The patterned surface is defined by a plurality of channels formed in the pad. Preferably, the channels extend in parallel non-intersecting pathways and terminate at the perimeter of the pad. The channels are each defined by a bottom and a pair of opposing side walls. Preferably, the side walls are tapered to define an angle relative to the bottom wall such that the channels define a plurality of elongated slanted protrusions.

In yet another aspect of the present invention, a pad having a polishing surface and a patterned surface is provided. The patterned surface is defined by a plurality of channels formed in the pad. Preferably, the channels extend in two substantially orthogonally related directions and terminate at the perimeter of the pad. The channels define a plurality of isolated slanted protrusions intermittently disposed on the pad in spaced-apart relation. Preferably, the isolated slanted protrusion are slanted in a common direction. In another embodiment, the protrusions may be slanted in more than one direction.

In yet another aspect of the invention, a platen is provided having a pad assembly disposed thereon. One surface of the pad assembly is patterned to define a raised area and a recessed area. The raised area provides a mounting surface for the platen and the recessed area provides a volume in which a desired degree of compliance and flexibility of the pad assembly is accommodated when the pad assembly is brought into contact with a substrate. Preferably, a portion of the recessed area extends to the perimeter of the pad assembly thereby forming pathways between the platen and the pad assembly that communicate with the pad environment.

In still another aspect of the invention, a platen is provided having a pad assembly disposed thereon. The pad assembly comprises a polishing pad and a plurality of protrusions disposed thereon. The protrusions are preferably intermittently disposed on the pad in isolation from one another and define a mounting surface having the platen mounted thereto. The protrusions define a plurality of intersecting grooves preferably extending at each end to the perimeter of the polishing pad.

In still another aspect of the invention, a platen is provided having a pad disposed thereon. The pad includes a polishing surface on a first side and a patterned surface on a second side. The patterned surface is defined by a plurality of channels formed in the pad. Preferably the channels extend in parallel non-intersecting pathways and terminate at the perimeter of the pad. The channels are each defined by a bottom and a pair of opposing side walls. Preferably, the side walls are tapered to define an angle relative to the bottom wall such that the channels define a plurality of elongated slanted protrusions. An outer surface of the elongated slanted protrusions provides a mounting surface for the platen.

In yet another aspect of the present invention, a platen is provided having a pad disposed thereon. The pad includes a polishing surface and a patterned surface. The patterned surface is defined by a plurality of channels formed in the pad. Preferably, the channels extend in two substantially orthogonally related directions and terminate at the perimeter of the pad. The channels define a plurality of isolated slanted protrusions intermittently disposed on the pad in spaced-apart relation. Preferably, the isolated slanted protrusion are slanted in a common direction. In another embodiment, the protrusions may be slanted in more than one direction. An outer surface of the isolated slanted protrusions provides a mounting surface for the platen.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention generally relates to a polishing pad having deflection areas formed therein. The deflection area is preferably vented to allow communication with the pad environment. In one embodiment, the deflection area includes a raised mounting portion and a recessed displacement portion wherein the raised portion defines a mounting surface for a platen. In another embodiment, the deflection area comprises one or more passageways formed through the pad. An upper surface of the pad defines a polishing surface and a lower surface provides a mounting surface for securing the pad to a platen.

For clarity and ease of description, the following description refers primarily to a CMP system. However, the invention is equally applicable to other types of processes that utilize a pad and platen assembly for polishing or cleaning a substrate.

Figure 2:
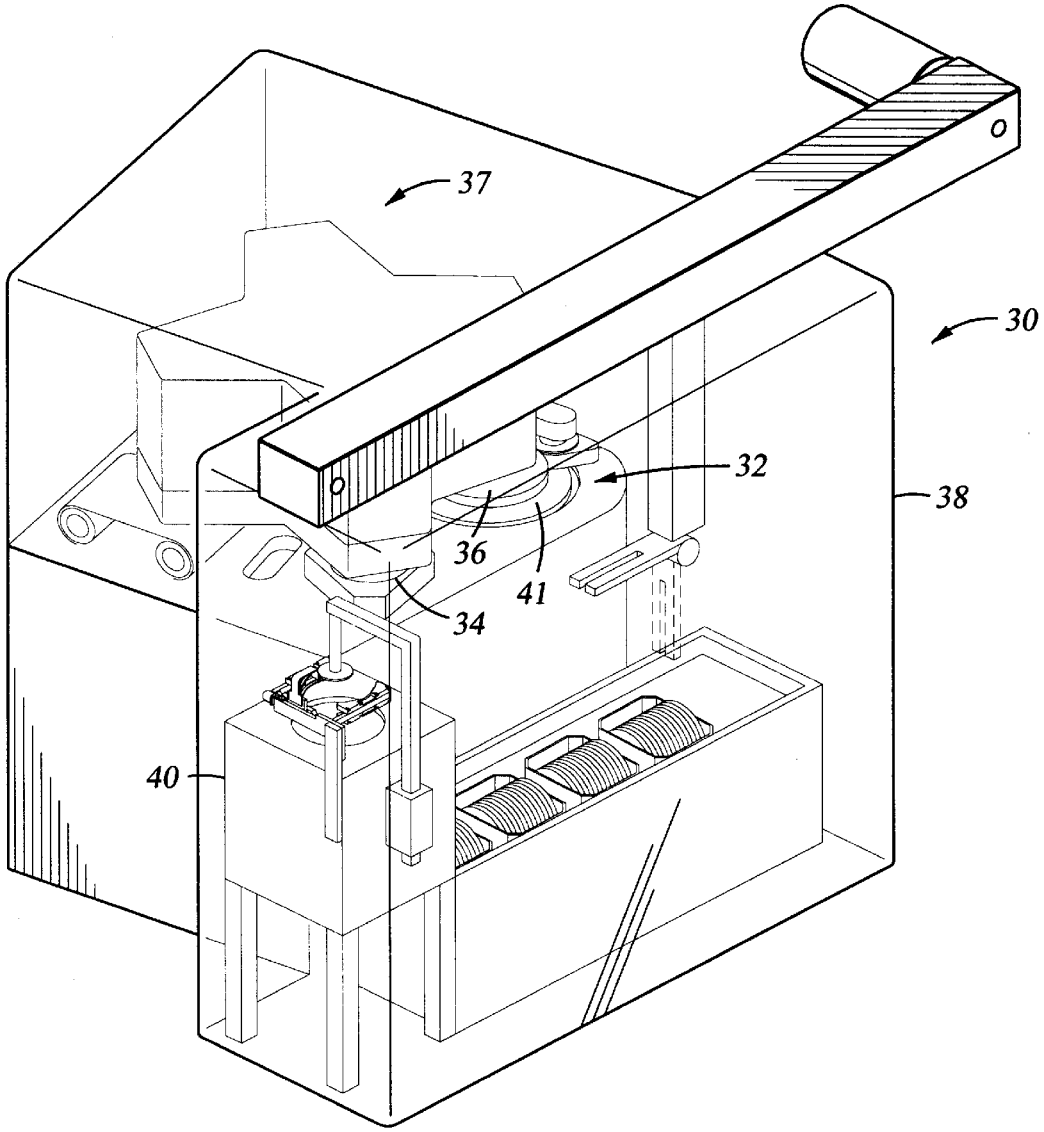
FIG. 2 is a schematic view of a CMP system.

FIG. 2 is a schematic view of a CMP system 30, such as a Mirra® CMP System available from Applied Materials, Inc., located in Santa Clara, Calif. The system shown includes three polishing stations 32 and a loading station 34. Four polishing heads 36 are rotatably mounted to a polishing head displacement mechanism 37 disposed above the polishing stations 32 and the loading station 34. A front-end substrate transfer region 38 is disposed adjacent to the CMP system and is considered a part of the CMP system, though the transfer region 38 may be a separate component. A substrate inspection station 40 is disposed in the substrate transfer region 38 to enable pre and/or post process inspection of substrates introduced into the system 30.

Typically, a substrate is loaded on a polishing head 36 at the loading station 34 and is then rotated through the three polishing stations 32. The polishing stations 32 each comprise a rotating platen 41 having polishing or cleaning pads mounted thereon. One process sequence includes a polishing pad at the first two stations and a cleaning pad at the third station to facilitate substrate cleaning at the end of the polishing process. At the end of the cycle the substrate is returned to the front-end substrate transfer region 38 and another substrate is retrieved from the loading station 34 for processing.

Figure 3:
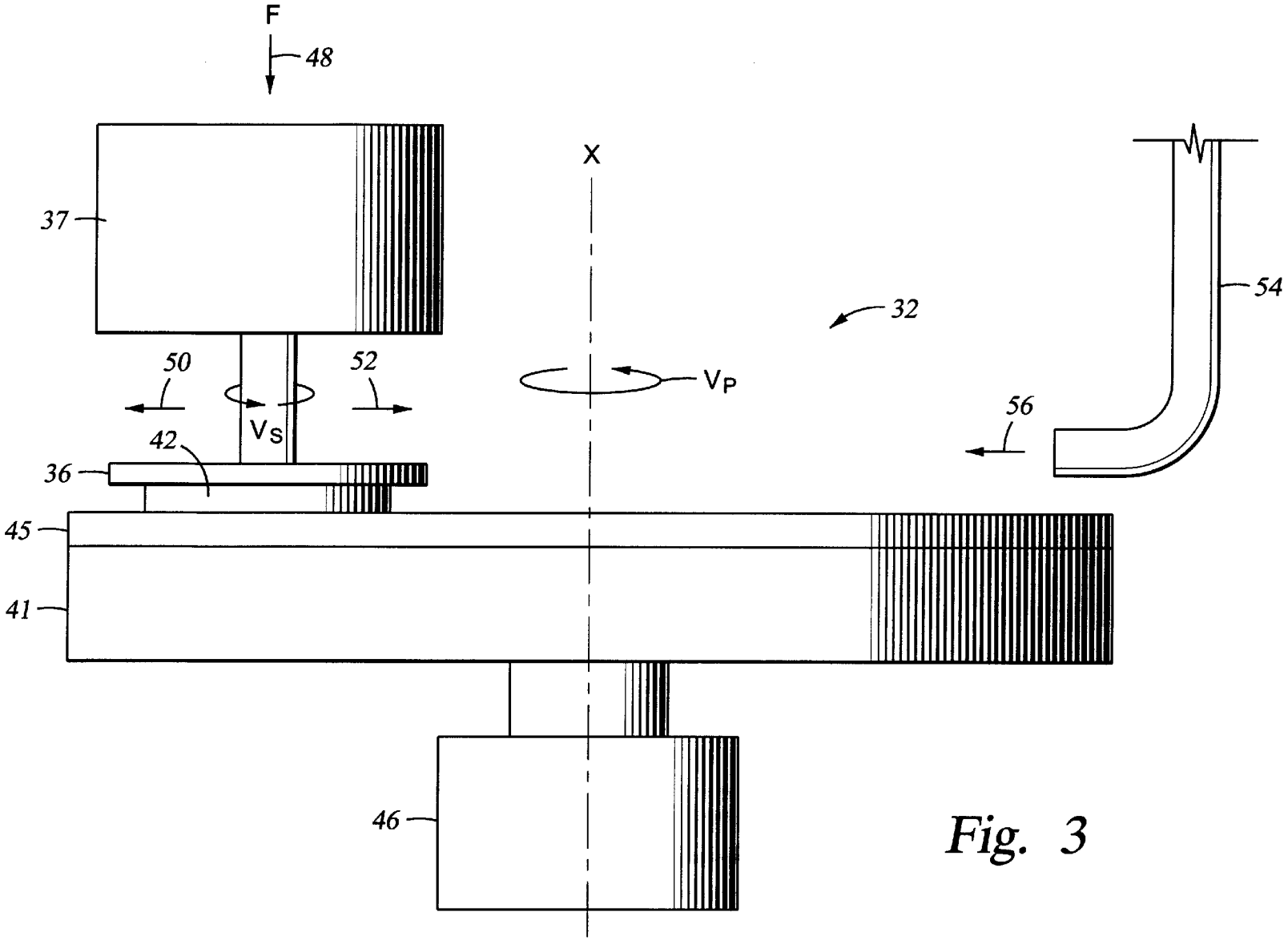
FIG. 3 is a schematic view of a polishing station.

FIG. 3 is a schematic view of a polishing station 32 and polishing head 36 used to advantage with the present invention. The polishing station 32 comprises a pad 45 assembly secured to an upper surface of a rotatable platen 41. The pad assembly 45 may utilize any commercially available pad supplied by manufacturers such as Rodel, Inc., of Newark, N. J., and preferably comprises a plastic or foam such as polyurethane as described in detail below. The platen 41 is coupled to a motor 46 or other suitable drive mechanism to impart rotational movement to the platen 41. During operation, the platen 41 is rotated at a velocity $V_p$ about a center axis X. The platen 12 can be rotated in either a clockwise or counterclockwise direction. FIG. 3 also shows the polishing head 36 mounted above the polishing station 32. The polishing head 36 supports a substrate 42 for polishing. The polishing head 36 may comprise a vacuum-type mechanism to chuck the substrate 42 against the polishing head 36. During operation, the vacuum chuck generates a negative vacuum force behind the surface of the substrate 42 to attract and hold the substrate 42. The polishing head 36 typically includes a pocket (not shown) in which the substrate 42 is supported, at least initially, under vacuum. Once the substrate 42 is secured in the pocket and positioned on the pad assembly 45, the vacuum can be removed. The polishing head 36 then applies a controlled pressure behind the substrate, indicated by the arrow 48, to the backside of the substrate 42 urging the substrate 42 against the pad assembly 45 to facilitate polishing of the substrate surface. The polishing head displacement mechanism 37 rotates the polishing head 36 and the substrate 42 at a velocity $V_s$ in a clockwise or counterclockwise direction, preferably the same direction as the platen 41. The polishing head displacement mechanism 37 also preferably moves the polishing head 36 radially across the platen 41 in a direction indicated by arrows 50 and 52.

With reference to FIG. 3, the CMP system also includes a chemical supply system 54 for introducing a chemical slurry of a desired composition to the polishing pad. In some applications, the slurry provides an abrasive material which facilitates the polishing of the substrate surface, and is preferably a composition formed of solid alumina or silica. During operation, the chemical supply system 54 introduces the slurry, as indicated by arrow 56, on the pad assembly 45 at a selected rate. In other applications the pad assembly 45 may have abrasive particles disposed thereon and require only that a liquid, such as deionized water, be delivered to the polishing surface of the pad assembly 45.

Figure 4:
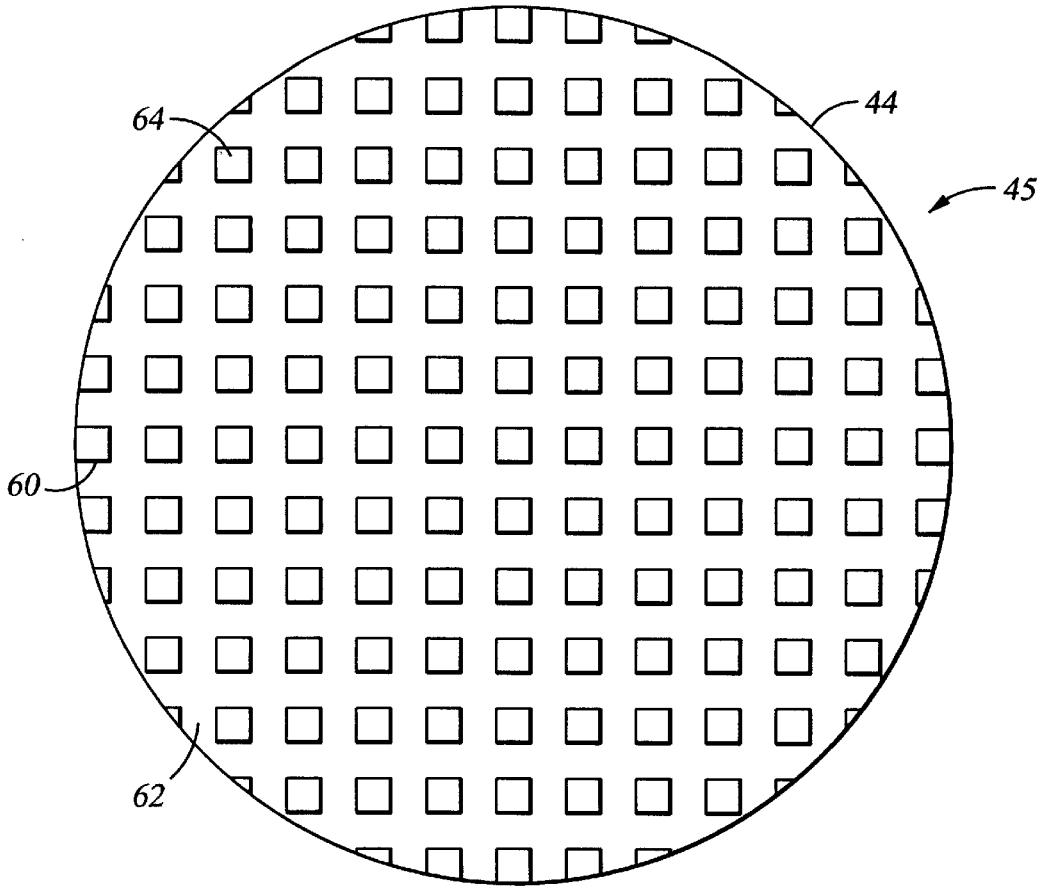
FIG. 4 is a bottom view of the polishing pad.
Figure 5:
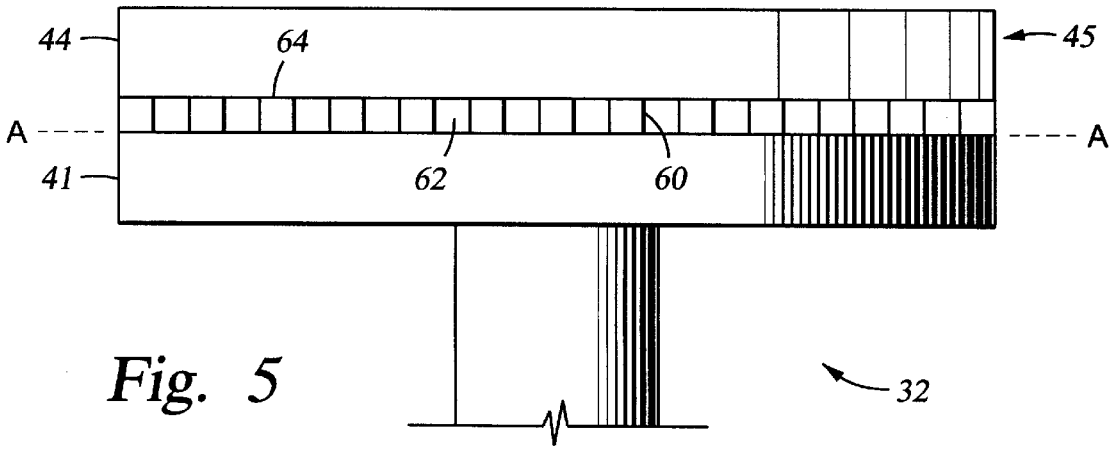
FIG. 5 is a schematic side view of the pad in FIG. 4 disposed on a platen.

FIGS. 4 and 5 show a bottom view and a side view, respectively, of a preferred embodiment of a polishing pad assembly 45 of the invention. The pad assembly 45 comprises a patterned surface for mounting to the platen 41. Generally, the patterned surface has features formed therein defining a raised area and a recessed area. In the embodiment shown in FIGS. 4 and 5, the raised area consists of a plurality of protrusions 60 disposed on a polishing pad 44 while the recessed area is a plurality of intersecting grooves 62 defined by the protrusions 60. More specifically, the recessed area consists of two parallel sets of equally spaced orthogonally intersecting grooves 62. Each of the grooves 62 traverses the lower surface of the polishing pad 44 from one perimeter to the another. Preferably, the grooves 62 are not sealed, or blocked, at either end. However, the present invention also contemplates an embodiment having blocked grooves.

Referring now to FIG. 5, a side view of the pad assembly 45 disposed on the platen 41 is shown. The raised areas, or protrusions 60, define a platen mounting surface. Preferably, the protrusions 60 cooperate to provide a substantially planar mounting surface 64 along a common plane A for interfacing with the platen 41. As noted above, the grooves 62 are preferably open at some point along their length. Thus, the grooves 62 provide pathways between the platen 41 and the polishing pad 44 which vent to the environment of the pad assembly 45 as shown in FIG. 5.

Figure 6:
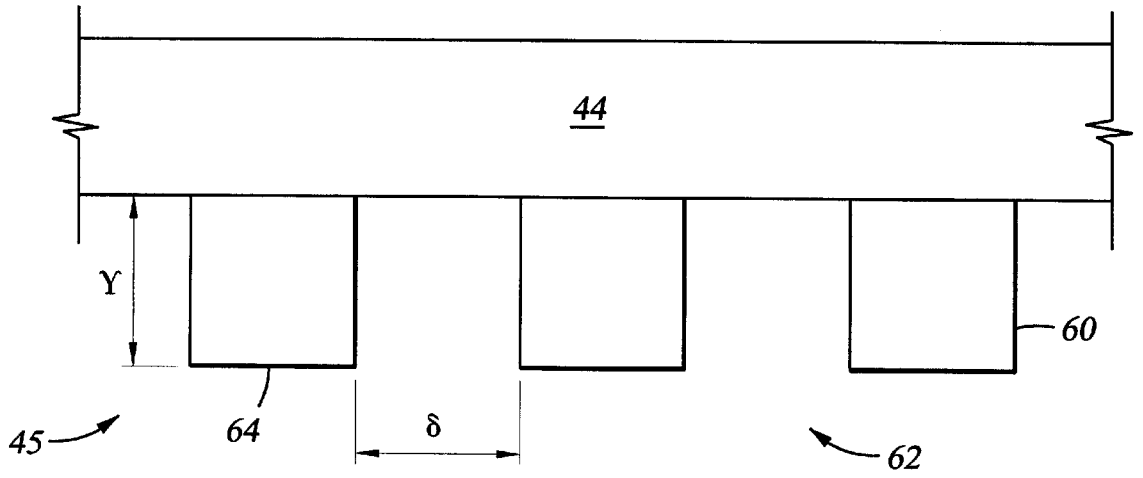
FIG. 6 is a partial cross sectional view of the pad of FIG. 4.

Referring to FIG. 6, a detailed partial cross sectional view of the pad assembly 45 is shown. The protrusions 60 are disposed on the lower surface of the polishing pad 44 and define isolated protuberances, or "islands," disposed uniformly on the polishing pad 44. Preferably, the protrusions 60 are equally thick and are equally spaced from one another. In the embodiment shown in FIG. 6, the protrusions 60 define a groove depth γ and define a groove width δ. The dimensions γ and δ are discussed in greater detail below.

The protrusions 60 are preferably chosen for their compressibility relative to the upper polishing pad 44. During operation, a pressure applied to the polishing pad 44 acts on the protrusions 60. The pressure causes the protrusions 60 to compress and deform elastically. To the extent that the protrusions 60 are caused to bulge outwardly when acted upon by the pressure, the effective groove width δ is diminished but not eliminated. Thus, the groove width δ between the protrusions 60 is preferably sufficient to allow the protrusions 60 to react to an applied pressure independently, without affecting the neighboring protrusions 60 by contact therewith. The applied pressure is relieved by the cooperation of the protrusions 60 and the grooves 62 without causing the polishing pad 44 to buckle or ripple. Thus, the pressure is localized to the point of origin and not transmitted to surrounding areas of the polishing pad 44 as is the case with conventional pads.

The dimensions of the patterned surface may be varied to achieve the desired proportions of compliance and rigidity. In general, the mounting surface 64 makes up to between about 20 to 95% of the total lower surface area but may be varied according to the pad thickness and modulus of elasticity, as well as the applied polishing pressure. In a specific embodiment of the pad assembly 45 shown in FIGS. 4–6 having a diameter of about twenty (20) inches and a polishing pad 44 having a thickness of between about 0.020 inches and 0.125 inches, the cross sectional dimensions for the protrusions 60 are about 0.25 inches (width) by 0.25 inches (length). Further, the groove depth γ (shown in FIG. 6) is preferably between 0.0050 inches and 0.080 inches and most preferably between about 0.010 inches and 0.032 inches and the groove width δ (shown in FIG. 6) is preferably between about 0.062 inches and 0.75 inches and most preferably between about 0.125 inches and 0.375 inches. In general, as the thickness of the upper polishing pad 44 is increased, the groove width δ is also preferably increased. The rigidity of the polishing pad 44 is generally a function of the thickness and modulus of elasticity of the polishing pad 44. An increase in either the modulus or the thickness causes increased rigidity and decreased compliance. Therefore, in order to maintain a desired degree of pad deflection or pliability, the groove width δ is preferably increased or decreased with an increase or decrease in pad thickness or modulus, respectively. Further, the diameter of the pad assembly 45 may be varied to accommodate any substrate size such as 100 mm, 200 mm or 300 mm substrates. As a result, relative sizes of the grooves 62 and protrusions 60 may vary accordingly.

The material used to construct the pad assembly 45 may vary depending on the desired degree of rigidity and compliance. In a preferred embodiment, the upper polishing pad 44 comprises a plastic or foam such as polyurethane and the protrusions 60 comprise a uniformly compressible plastic, foam or rubber. One pad which may be used to advantage is the Suba IV from Rodel, Inc. The polishing pad 44 and the protrusions 60 may be mounted to one another and to the platen 41 using a conventional adhesive such as a pressure sensitive adhesive.

The selection of materials for the polishing pad 44 and the protrusions 60 is largely dependent on their respective hydrostatic moduli. The hydrostatic modulus measures the resistance to change in the volume without changes in the shape under a hydrostatic pressure P. The hydrostatic modulus K equals $(Pv)/(\Delta v)$, where P is the hydrostatic pressure applied to a layer (assuming that the layer is initially under no pressure), and $(v)/(\Delta v)$ is the volumetric strain.

Preferably, the protrusions 60 have a low hydrostatic modulus relative to the polishing pad 45. Thus, the hydrostatic modulus of the protrusions 60 is less than about 400 psi per psi of compressive pressure when a compressive pressure in the range of 2 to 20 psi. The hydrostatic modulus of the polishing pad 44 is greater than about 400 psi per psi of compressive pressure when a compressive pressure in the range of 2–20 psi. The low hydrostatic modulus of the protrusions 60 permits the protrusions 60 to elastically deform while the high hydrostatic modulus of the polishing pad 44 promotes a degree of bridging across high points on a substrate to planarize the same. Thus, the cooperation of the polishing pad 44 and the protrusions 60 achieves both within-die and within-substrate uniformity.

Figure 11:
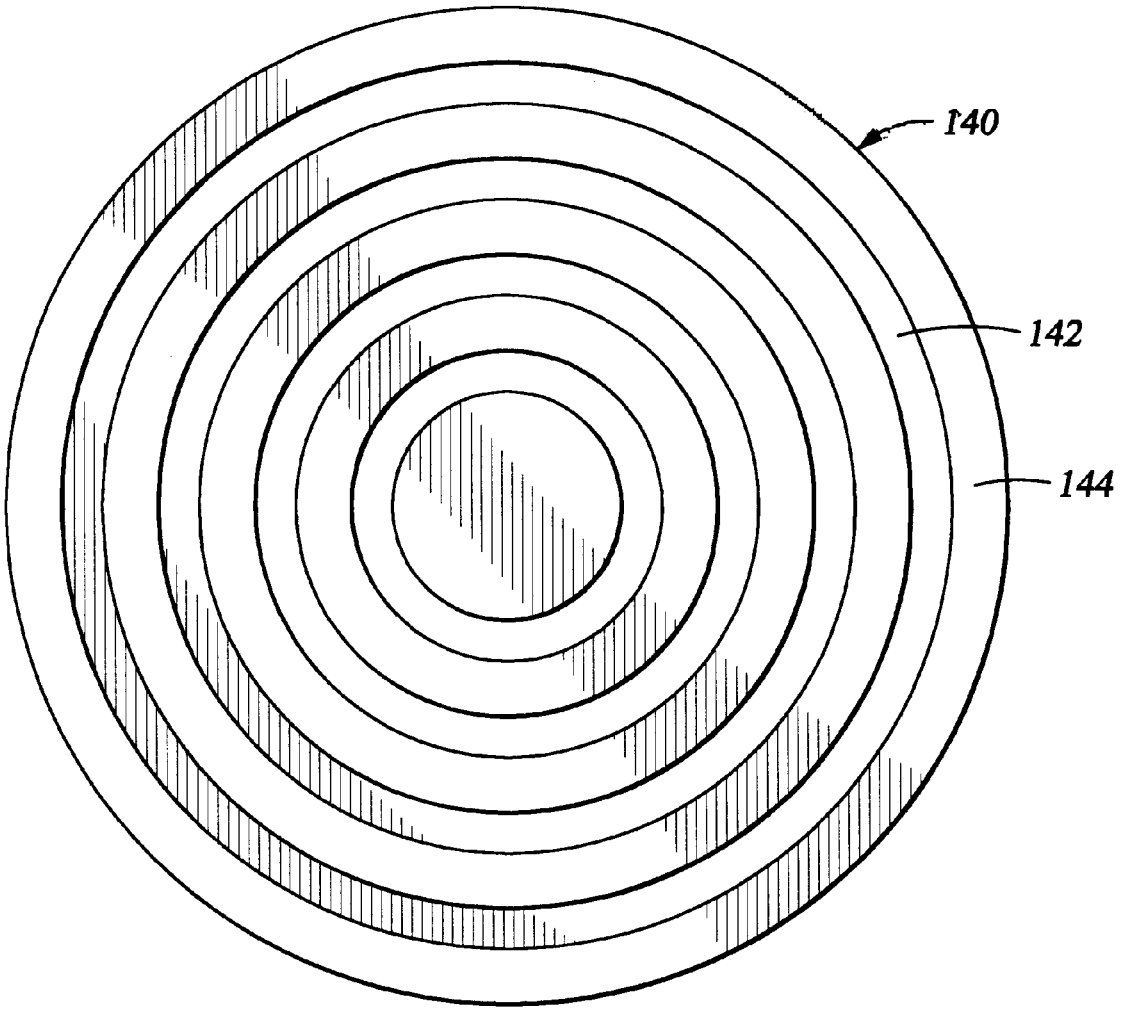
FIG. 11 is a bottom view of the pad showing an alternative embodiment.

The inventors have found that the present invention may be used to advantage with varying polishing pad designs including pads having a smooth polishing surface, a grooved polishing surface, a perforated polishing surface and the like. The particular polishing pad used does not limit the present invention. One pad commonly used is the IC1000 with perforations available from Rodel, Inc., which allows fluid flow through the pad. Where such perforated polishing pads are used, the grooves 62 of the polishing pad assembly 45 are preferably open at some point along their length, as shown in FIGS. 4 and 5. Thus, the grooves 62 provide pathways between the platen 41 and the polishing pad 44 which vent to the environment of the pad assembly 45. Where the grooves are isolated from the environment, such as where the grooves comprise concentric circles enclosed at the bottom by a platen, a partial vacuum condition may be created in the grooves as a substrate is urged against the polishing pad making subsequent removal of the substrate from the polishing pad more difficult. FIG. 11 shows a bottom view of an illustrative pad 140 having concentric grooves 142 recessed below a platen mounting surface 144. By constructing the grooves 62 as shown in FIGS. 4 and 5, the grooves 62 remain at equal pressure to the ambient environment allowing easy removal of the substrate from the polishing pad 44 where a perforated pad is employed because the perforations communicate with the grooves 62 preventing a vacuum from being created between the pad and the substrate. In addition, the grooves 62 may also facilitate removal of the polishing pad 44 from the platen 41.

Figure 7:
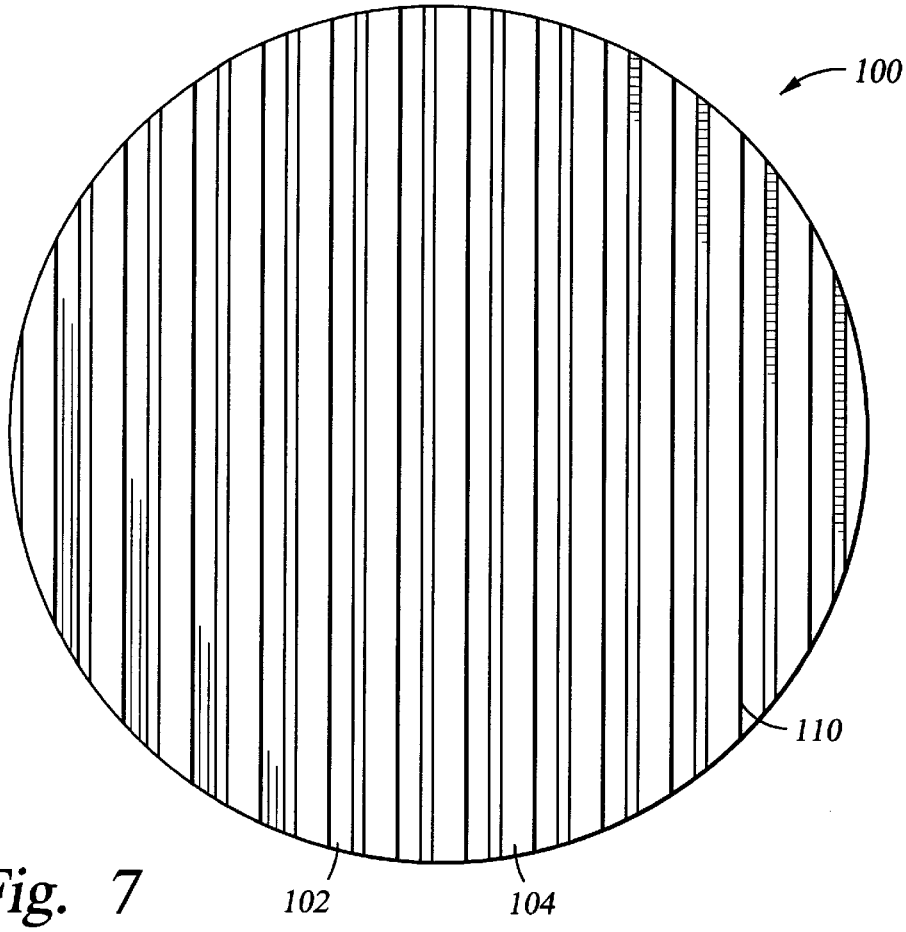
FIG. 7 is a bottom view of the pad showing an alternative embodiment.
Figure 8:
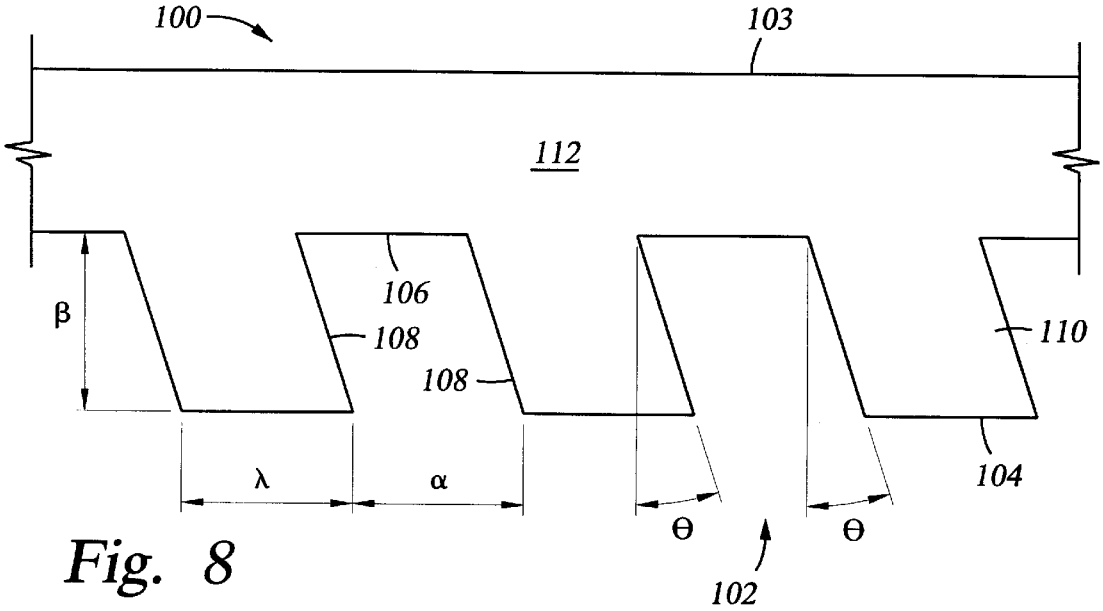
FIG. 8 is a partial cross sectional view of the pad of FIG. 7.

FIGS. 7 and 8 show an alternative embodiment of the present invention. In FIG. 7, a bottom view of a pad 100 is shown having a plurality of channels 102 formed therein. The channels 102 extend in parallel to one another and terminate at the perimeter of the pad 100. Thus, each of the channels 102 defines an independent non-intersecting pathway. The lower surface of the pad 100 defines a mounting surface 104 for a platen and the upper surface defines a polishing surface 103 (shown in FIG. 8). The pad 100 may be affixed to the platen by providing an adhesive to the mounting surface 104 and then disposing the pad 100 against the pad 100.

FIG. 8 is a partial cross sectional view of the pad 100 showing the details of the channels 102. Each of the channels 102 is defined by a bottom wall 106 and a pair of opposing side walls 108. The side walls 108 are tapered in a common direction. Preferably, the side walls 108 define an angle e relative to the bottom wall 106 such that the channels 102 define a plurality of elongated slanted protrusions 110 extending from a base 112 of the pad 100. FIG. 8 also shows a channel width α (as determined by the bottom wall), a channel height β, and a width λ of the slanted protrusions 110.

The material and dimensions of the pad 100 are selected to promote both rigidity and compliance. Preferably, the pad 100 is made of a material having a high hydrostatic modulus such as the IC1000 available from Rodel, Inc. The dimensions may be varied according to the specifications of the material, i.e., compressibility, rigidity, etc. However, in general, for a twenty inch pad, the angle θ is preferably between about zero (0) degrees and sixty (60) degrees, the channel width α is between about 0.062 inches and 0.375 inches, the channel depth β is between about 0.010 inches and 0.050 inches and the width λ of the slanted protrusions 110 is between about 0.010 inches and 0.75 inches.

In general, increasing the angle θ provides greater compliance of the pad 100 in response to an applied pressure. Conversely, decreasing the angle θ provides greater rigidity. Thus, the angle θ may be selected according to a particular application.

Figure 1:
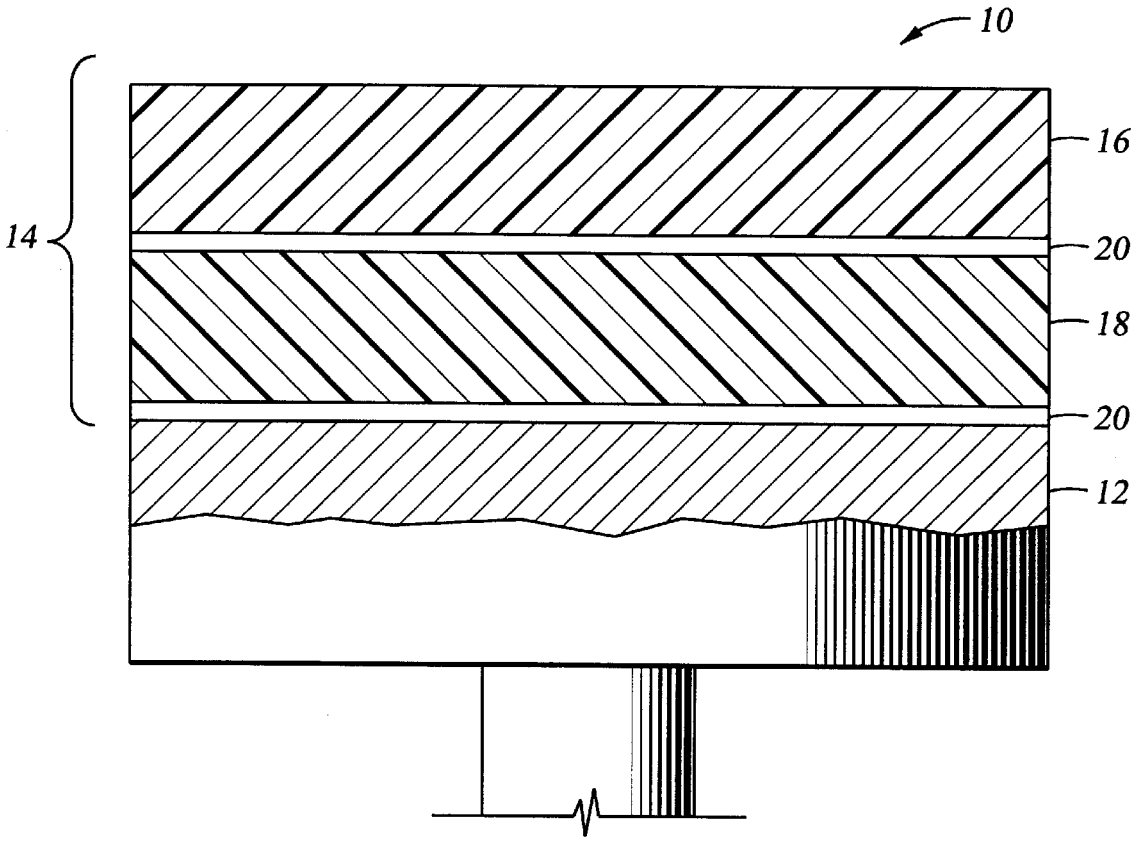
Fig. 1 (PRIOR ART)
FIG. 1 is a schematic side view of a platen and composite polishing pad assembly.

Because the polishing pad 100 is attached directly to a platen, the need for the intermediate pad(s) of prior art (discussed above with reference to FIG. 1) is eliminated. Further, the necessary pad compliance, previously achieved by using a bottom pad, is now provided by the cooperation of the pad's unique features. The bulk of the pad 100, comprising primarily of the base 112, ensures sufficient rigidity (stiffness) while the channels 102 and plurality of elongated slanted protrusions 110 allow the proper proportion of pad compliance (flexibility) to accommodate a substrate's varying topography.

Figure 9:
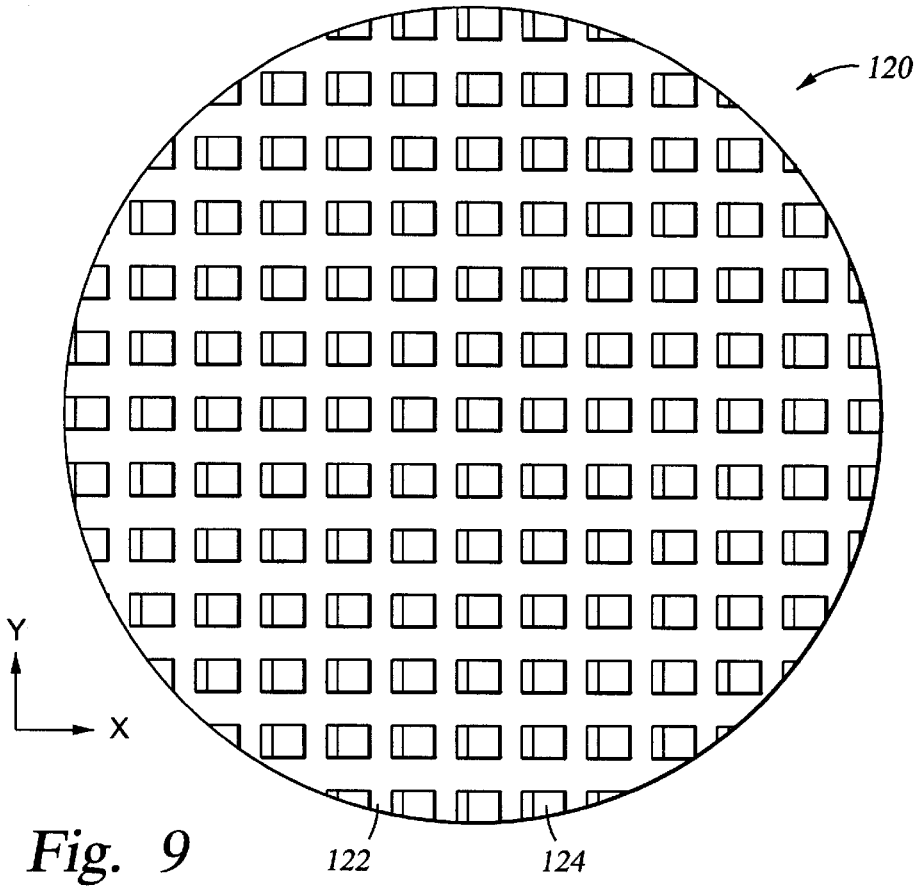
FIG. 9 is a bottom view of the pad showing an alternative embodiment.

While FIG. 7 shows parallel channels extending in only one direction, another embodiment comprises multidirectional intersecting channels. FIG. 9 shows an alternative embodiment of a pad 120 of the present invention having channels 122 formed in substantially two orthogonally related directions. The channels 122 define a plurality of isolated slanted protrusions 124 intermittently disposed on the pad 120 in spaced-apart relation. The isolated slanted protrusions 124 are slanted in a common direction, shown in FIG. 9 as the x-direction. In another embodiment, the protrusions 124 may be slanted in more than one direction, such as the x and y-direction for example.

Figure 10:
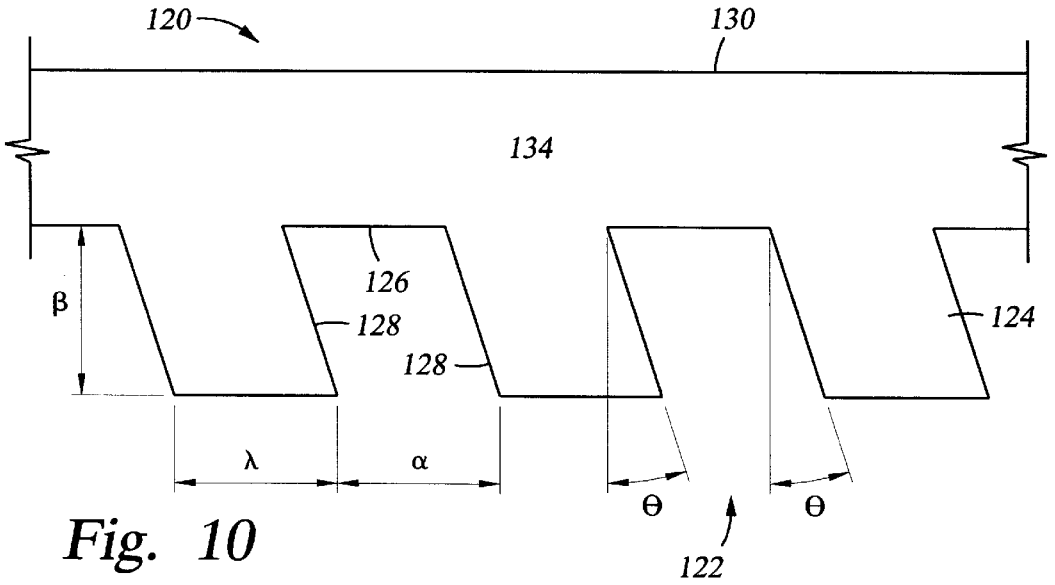
FIG. 10 is a partial cross sectional view of the pad of FIG. 9.

FIG. 10 shows a cross sectional view of the polishing pad 120 having a polishing surface 130 on a first side and the plurality of isolated slanted protrusions 124 on a second side. Each of the channels 122 is defined by a bottom wall 126 and a pair of opposing side walls 128. The side walls 128 are tapered in a common direction. Preferably, the side walls 128 define an angle e relative to the bottom wall 126 such that the intersecting channels 122 define the plurality of isolated slanted protrusions 124 extending from a base 134 of the pad 120. FIG. 10 also shows a channel width α, a channel height β and a width λ of the isolated slanted protrusions 124. The cross sectional profile of the isolated slanted protrusions 124 is substantially the same as that of the elongated slanted protrusions 110 shown in FIG. 8. Thus, the dimensions (α,β and λ) described above with reference to FIG. 8 are equally applicable to the embodiment of FIGS. 9 and 10.

The upper polishing surface 103, 130 of the polishing pads 100, 120, respectively, may be any conventional design. Thus, while FIGS. 8 and 10 show substantially smooth or planar polishing surfaces 103, 130, textured and/or perforated polishing surfaces may also be used to advantage.

It is to be understood that terms such as top, bottom, upper, lower, below, above, backside and the like, are relative terms and are not intended to be limiting. Other configurations are contemplated where a substrate can be handled in different orientations.

While foregoing is directed to the preferred embodiment of the present invention, other and further embodiments of the invention may be devised without departing from the basic scope thereof, and the scope thereof is determined by the claims that follow.

What is claimed is:

1. A substrate polishing pad having a polishing surface on a first side and a patterned surface on a second side, the patterned surface comprising:

a plurality of raised portions defining a platen mounting surface and a recessed area between the plurality of raised portions, wherein the platen mounting surface is disposable on a platen without use of an intermediary pad located between the platen mounting surface and the platen.

2. The substrate polishing pad of claim 1, wherein the recessed area comprises a plurality of grooves.

3. The substrate polishing pad of claim 1, wherein at least a portion of the recessed area extends to a perimeter of the substrate polishing pad.

4. The substrate polishing pad of claim 1, wherein the substrate polishing pad comprises polyurethane.

5. The substrate polishing pad of claim 1, wherein the plurality of raised portions comprise a plastic foam.

6. The substrate polishing pad of claim 1, wherein the plurality of raised portions comprises a material selected from plastic, foam, rubber, and any combination thereof.

7. The substrate polishing pad of claim 1, wherein the plurality of raised portions comprises a first material and the polishing surface comprises a second material.

8. The substrate polishing pad of claim 1, wherein the plurality of raised portions comprise isolated protrusions.

9. The substrate polishing pad of claim 1, wherein the plurality of raised portions comprise a first hydrostatic modulus at a first compressive pressure and the polishing surface comprises a second hydrostatic modulus at the first compressive pressure.

10. The substrate polishing pad of claim 9, wherein the first hydrostatic modulus is less than the second hydrostatic modulus.

11. The substrate polishing pad of claim 9, wherein the first hydrostatic modulus is less than about 400 psi per psi of the first compressive pressure and wherein the second hydrostatic modulus is greater than about 400 psi per psi of the first compressive pressure when the first compressive pressure is between about 2 to 20 psi.

12. The substrate polishing pad of claim 1, wherein the plurality of raised portions are separated from one another by a distance between about 0.062 inches and about 0.75 inches and have a width of about 0.010 inches and about 0.75 inches.

13. The substrate polishing pad of claim 1, wherein the recessed area has a depth from the mounting surface to a floor between about 0.0050 inches and about 0.080 inches.

14. A substrate polishing pad, comprising:

(a) a polishing surface on a first side; and (b) a patterned surface on a second side, the patterned surface comprising a recessed area and a raised platen mounting surface, wherein the raised platen mounting surface is disposable on a platen without use of an intermediary pad located between the raised platen mounting surface and the platen and wherein the recessed area and the raised platen mounting surface define a plurality of channels extending substantially parallel to the polishing surface.

15. The substrate polishing pad of claim 14, wherein at least a portion of the plurality of channels extends to a perimeter of the substrate polishing pad to allow fluid communication between the portion of the plurality of channels and an environment of the substrate polishing pad.

16. The substrate polishing pad of claim 14, wherein the plurality of channels are concentrically disposed.

17. The substrate polishing pad of claim 14, wherein the substrate polishing pad comprises polyurethane.

18. The substrate polishing pad of claim 14, wherein the patterned surface comprises a plastic foam.

19. The substrate polishing pad of claim 14, wherein the plurality of channels comprise a plurality of non-intersecting pathways formed in the substrate polishing pad defining elongated slanted protrusions.

20. The substrate polishing pad of claim 14, wherein the plurality of channels comprise a plurality of intersecting pathways formed in the substrate polishing pad defining isolated slanted protrusions.

21. The substrate polishing pad of claim 14, wherein each channel of the plurality of channels is defined a bottom wall and by tapered sidewalls formed in the substrate polishing pad.

22. The substrate polishing pad of claim 21, wherein each of the tapered sidewalls and the bottom wall define an angle between about zero degrees and sixty degrees.

23. The substrate polishing pad of claim 14, wherein the plurality of channels have a width between about 0.062 inches and about 0.75 inches and wherein the raised platen mounting surface comprises a plurality of protrusions having a width between about 0.010 inches and about 0.75 inches.

24. The substrate polishing pad of claim 14, wherein the plurality of channels have a depth from the raised platen mounting surface to a floor between about 0.0050 inches and about 0.080 inches.

25. An apparatus for polishing a substrate, comprising:

(a) rotatable platen comprising an upper pad mounting surface; and (b) a polishing pad disposed on the rotatable platen and comprising a polishing surface on a first side and a patterned surface on a second side disposed on the upper pad mounting surface without an intermediary pad located between the patterned surface and the upper pad mounting surface, the patterned surface comprising a plurality of isolated raised portions defining a platen mounting surface disposed on the platen and further defining a recessed area between the plurality of isolated raised portions.

26. The apparatus of claim 25, further comprising:

(a) a motor coupled to the rotatable platen; and (b) one or more polishing heads rotatably mounted in facing relation to the rotatable platens.

27. The apparatus of claim 25, wherein the polishing surface comprises a first material and the patterned surface comprises a second material.

28. The apparatus of claim 25, wherein the polishing pad comprises polyurethane.

29. The apparatus of claim 25, wherein the patterned surface comprises a plastic foam.

30. The apparatus of claim 25, wherein the patterned deflection surface and the platen define a plurality of pathways.

31. The apparatus of claim 26, wherein at least a portion of the plurality of pathways extends to a perimeter of the polishing pad to allow fluid communication between the portion of the plurality of pathways and an environment of the polishing pad.

32. The apparatus of claim 25, wherein the patterned surface comprises a plurality of slanted protrusions.

33. The apparatus of claim 25, wherein the plurality of isolated raised portions comprise a first material and the polishing surface comprises a second material.

34. The apparatus of claim 25, wherein the plurality of isolated raised portions comprise a material selected from plastic, foam, or rubber, and the polishing pad comprises polyurethane.

35. The apparatus of claim 25, wherein the plurality of isolated raised portions comprise a first hydrostatic modulus at a first compressive pressure and the polishing pad comprises a second hydrostatic modulus at the first compressive pressure.

36. The apparatus of claim 35, wherein the first hydrostatic modulus is less than the second hydrostatic modulus.

37. The apparatus of claim 29, wherein the recessed area comprises a plurality of grooves.

38. The substrate polishing pad of claim 25, the plurality of isolated raised portions have a width between 0.010 inches and about 0.75 inches and are separated from one another by a distance between about 0.062 inches and about 0.75 inches.

39. The substrate polishing pad of claim 29, wherein the one or more isolated raised portions have a height from the raised mounting surface to a floor of the patterned deflection surface between about 0.0050 inches and about 0.080 inches.

40. The apparatus of claim 25, wherein the patterned surface comprises a plurality of non-intersecting channels formed in the polishing pad.

41. The apparatus of claim 40, wherein the polishing pad comprises polyurethane.

42. The apparatus of claim 40, wherein at least a portion of the plurality of non-intersecting channels extends to a perimeter of the polishing pad to allow fluid communication between the portion of the plurality of non-intersecting channels and an environment of the polishing pad.

43. The apparatus of claim 40, wherein each of the channels of the plurality of non-intersecting channels are defined by a bottom wall and by tapered sidewalls formed on the substrate polishing pad.

44. The apparatus of claim 43, wherein each of the tapered sidewalls and the bottom wall define an angle between about zero degrees and sixty degrees.

* * * * *

UNITED STATES PATENT AND TRADEMARK OFFICE

CERTIFICATE OF CORRECTION

PATENT NO. : 6,217,426 B1
DATED : April 17, 2001
INVENTOR(S) : Tolles et al.

It is certified that error appears in the above-identified patent and that said Letters Patent is hereby corrected as shown below:

Column 1,
Line 1, please replace "CM P" with -- CMP --.

Column 8,
Line 62, please replace "e" with -- θ --.

Column 9,
Line 47, please replace "e" with -- θ --.

Signed and Sealed this

Twelfth Day of August, 2003

JAMES E. ROGAN
*Director of the United States Patent and Trademark Office*